United States Patent [19]

Moller

[11] 4,067,453

[45] Jan. 10, 1978

[54] PIPE DELIVERY SYSTEM

[75] Inventor: Walter H. Moller, Bellevue, Wash.

[73] Assignee: Western Gear Corporation, Everett, Wash.

[21] Appl. No.: 678,159

[22] Filed: Apr. 19, 1976

[51] Int. Cl.[2] ..... E21B 19/14

[52] U.S. Cl. ..... 214/2.5; 175/85; 198/485; 198/750; 214/1 PB

[58] Field of Search ..... 214/2.5, 1 P, 1 PB, 214/64, 16.4 R; 175/52, 85; 198/435, 485, 601, 750

[56] References Cited

U.S. PATENT DOCUMENTS

| | | | |
|---|---|---|---|
| 2,763,236 | 9/1956 | Cummings | 214/1 PB X |
| 3,268,095 | 4/1966 | Durbin | 214/2.5 |
| 3,382,992 | 5/1968 | Coachman | 214/64 |
| 3,601,270 | 8/1971 | Martin | 214/16.4 R X |
| 3,805,945 | 4/1974 | Maeda | 214/1 PB X |

FOREIGN PATENT DOCUMENTS

| | | | |
|---|---|---|---|
| 1,088,429 | 9/1960 | Germany | 214/64 |

*Primary Examiner*—Robert J. Spar
*Assistant Examiner*—George F. Abraham
*Attorney, Agent, or Firm*—Seed, Berry, Vernon & Baynham

[57] ABSTRACT

A pipe delivery system and method in which pipe is fed to the drilling rig floor by carrying the pipe in a single elongated skate along a horizontal and then upwardly inclined ramp so that the end of the pipe can be hoisted upwardly off the skate. Pipe is kicked off the skate laterally onto pipe delivery ramp plates by pushing ejector plates carried by the skate upwardly into an angle to cause the pipe to roll off the skate and down the delivery ramp plates. The ejector plates are actuated by pistons and cylinders housed in a retracted position below the path of the skate and which are extended upwardly against the ejector plates. The pipe is delivered by gravity rolling the pipe either from or to the skate by selectively positioning ramp plates with the desired lateral inclination at each side of the skate and providing indexing fingers which are movable into the path of the pipe on the ramp for separating an endmost pipe for removal. Pipe is transferred between vertically spaced layers of pipe racks and the skate location by rollers which are powered to move the pipe along the pipe axis and which are also vertically positionable for carrying the pipe between the delivery ramp plates and the various layers of the pipe racks.

37 Claims, 18 Drawing Figures

58
29
35
38
P
30
101
5
24
65'
65
54
52
39

FIG. 5
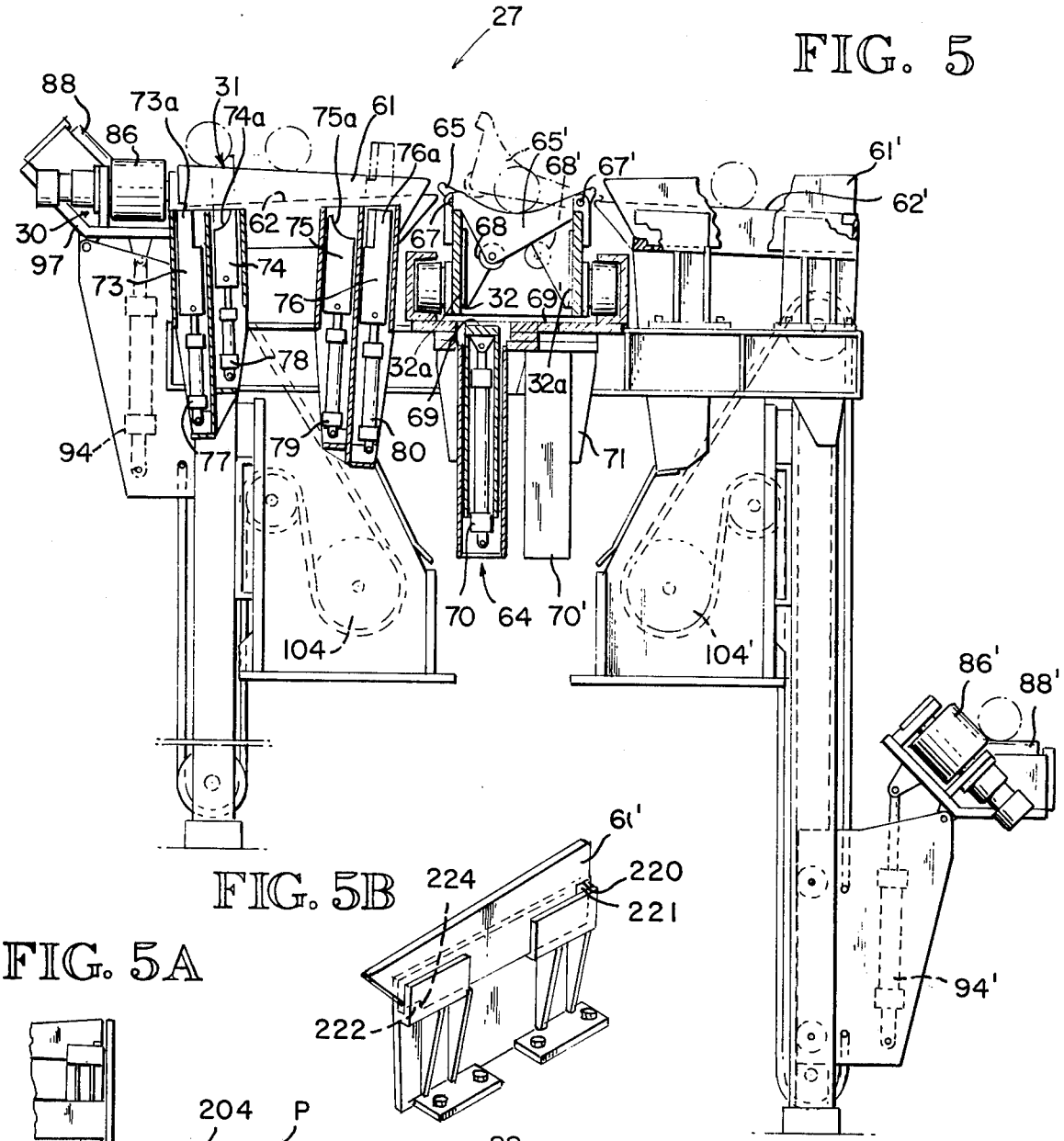
FIG. 5B
FIG. 5A
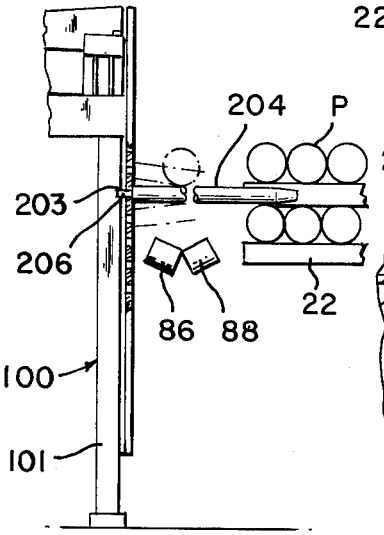
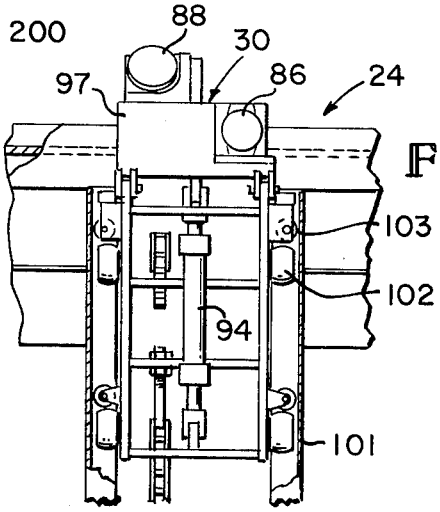
FIG 6

PIPE DELIVERY SYSTEM

BACKGROUND OF THE INVENTION

1. Field of the Invention

This invention pertains to apparatus and methods for moving pipe back and forth between storage racks and a drilling rig floor. More particularly, it pertains to overall pipe moving systems as well as component features of the overall system.

2. Description of the Prior Art

The use of a skate for supporting the end of a pipe or the use of pairs of independent skates for simultaneously supporting the opposite ends of pipe as the pipe is moved to and from the drilling rig floor are known. One typical example is shown in U.S. Pat. No. 3,268,095. These systems, however, which have used single or plural skates are complicated in operation.

Various types of pipe delivery systems and tripping techniques for moving the pipe off a skate are also known. In some instances, the entire skate is tipped and in other instances, pipe ejector ramps are raised from below the skates to hit the pipe off the skate. An example of the latter is shown in U.S. Pat. No. 3,315,822. In this patent the skate consists of a pair of carriages arranged to carry the pipe along a horizontal track to a point where the derrick end of the pipe is elevated from its carriage by an air cylinder to move the pipe into an upwardly sloped position.

Several pipe handling systems have been tried for moving drill pipe from a ground level storage area to the elevated floor of an oil drilling rig for vertical coupling to the drill string. Since several hundred lengths of pipe are normally required to drill a hole and these must be tripped to replace the bit from time to time, speeding of the in-and-out process with a minimum of manual effort is important.

Various types of pipe transferring devices are known for moving pipe to and from vertically-spaced layers or racks of pipe. In some instances, the entire storage rack is hoisted to the desired skate level.

SUMMARY OF THE INVENTION

It is an object of this invention to provide an improved pipe feeding apparatus and method of moving pipe which employs a skate movable along an elongated track.

It is another object to provide a pipe handling system for moving pipe back and forth between a drill rig and storing racks.

it is another object of this invention to provide method and apparatus for tripping pipe off from an elongated skate.

It is still another object of this invention to provide a pipe delivery method and apparatus in which the inclination of a pipe rolling ramp plate can be arranged manually at low cost.

It is still another object of this invention to provide a pipe transferring apparatus and method which can maneuver pipe longitudinally between storage racks and a skate for positioning the pipe.

It is another object of this invention to provide pipe transferring apparatus and method which can move the pipe vertically as well as longitudinally for locating the pipe between vertically spaced pipe storage racks and a skate at a pipe transporting zone.

Basically these objects are obtained by providing a pipe storage zone, pipe transfer zone, pipe rolling zone, and pipe transporting zone adjoining one another in the recited order, the pipe storage zone having a bank of vertically spaced racks, pipe rolling means and indexing means provide a gently sloped variable roll path toward or away from a skate in the transporting zone, means for moving the skate to an elevated position adjacent a pipe using zone on a drill rig, and pipe unloading means in said transporting zone including unloading ejectors for moving a length of pipe from the skate to a transporting station, including actuating means beneath and free of the skate for powering the unloading ejectors. In the preferred embodiment, the skate supports both ends of the pipe and when advanced, the forward end of the skate rides up a ramp carrying the pipe forward end to the drilling rig floor. Pipe as used herein means drill pipe, drill collar, casing or the like having various diameters, for example 5, 7, 9⅝, 13⅜, 20 inches, and various lengths, for example, 28–45 feet.

Still a further feature of the invention in the preferred embodiment is the use of two sets of laterally inclined ramp plates, one set of which can be removed exposing the other set with the other set having an inclination opposite to that of the first set. In this way, the ramp plate inclination can be quickly changed. Hydraulic or suitable actuating means can also be adapted to reverse the inclination.

Still a further feature of the invention is the provision of powered rollers which can longitudinally position a pipe so that the tool joint of the pipe extends beyond the end of the skate for attaching the rig floor elevators or it can position the pipe longitudinally for aligning it with the pipe racks. In the preferred embodiment the powered rollers are also positionable vertically to be aligned with the entrance ends or exit ends of the sets of laterally inclined ramp plates or vertically positioned to align the pipe with one of several vertically spaced horizontal racks. By providing the powered rolls for longitudinal movement of the pipe, the skate may always be returned until contact is made with the skate bumper. This is necessary to align the ejector plates with the ejector cylinders. The various lengths of pipes can then be readily positioned in proper alignment for delivery to the skate. The use of the powered rollers for vertical conveying of the pipe from various vertically spaced racks also reduces the need for expensive auxiliary conveying systems.

BRIEF DESCRIPTION OF THE FIGURES OF THE DRAWINGS

FIG. 5 is vertical section taken along the line 5—5 of FIG. 2.

FIG. 5A is a fragmentary schematic of the pipe rack and transfer mechanism.

FIG. 5B is an isometric view of a ramp plate and its supporting frame.

FIG. 6 is a fragmentary side elevation of a portion of a pipe transfer apparatus shown in FIG. 5.

FIG. 10 illustrates a pipe being transferred from an uppermost storage rack. FIG. 11 shows a pipe from the opposite side of the pipe feeder being readied for delivery to the pipe feeding apparatus.

FIG. 12 shows a second pipe in position on the pipe feeding apparatus.

FIG. 13 shows a pipe from the right hand (as viewed in FIG. 13) storage rack being held in a ready position for delivery to the pipe feeding apparatus.

FIG. 14 shows the pipe after it has just been delivered to the skate.

FIG. 15 shows the skate having been advanced up a ramp to elevate the pipe for attachment of the drawworks elevators.

FIG. 16 illustrates the pipe being hoisted all the way up the skate and ready to be cleared of the skate.

DETAILED DESCRIPTION OF THE PREFERRED EMBODIMENT

Figure 10:
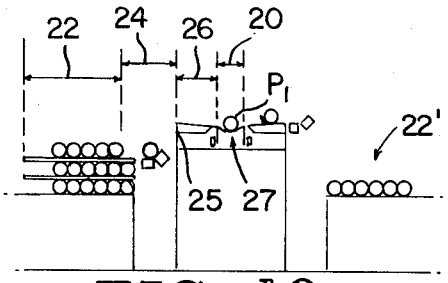
FIGS. 10–13 are operational schematics.

As indicated in FIG. 10, the pipe handling system of the present invention utilizes at each side of a central pipe transporting zone 20, an outer pipe storage zone 22, a pipe transfer zone 24, and a pipe rolling zone 26. Throughout the following description, corresponding parts on the right-hand side of the system will be given the same identifying numerals as on the left-hand side thereof followed by a prime.

Figure 14:
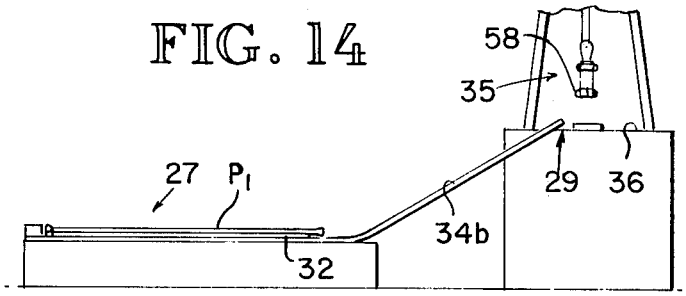
FIGS. 14–16 are operational schematics illustrating feeding of a pipe from a pipe delivery location to the drilling rig floor.
Figure 15:
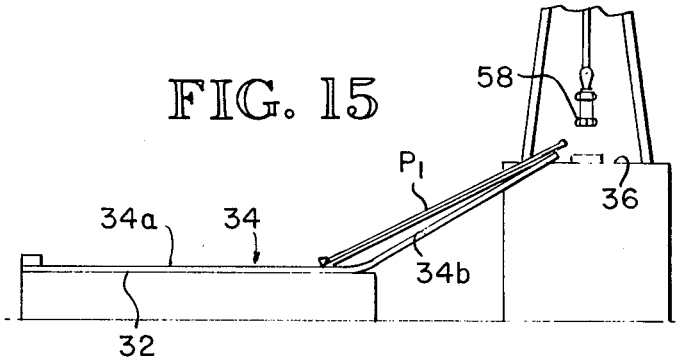
Figure 16:
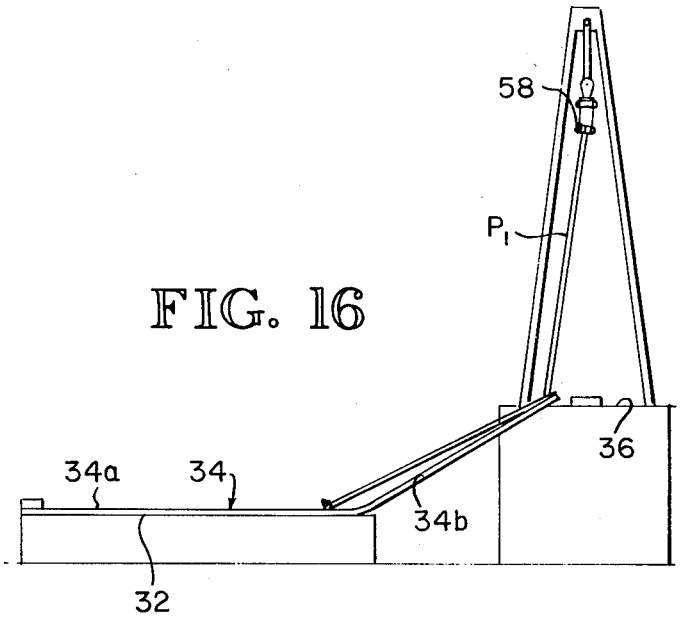

The pipe is stored in the storage zone in suitable multi-level layers preferably separated by battens and is rolled to and from respective of pipe storage stations 23 at the inner side of the storage zone at its junction with the transfer zone 24. In the transfer zone the pipe is moved by transfer means 30 to and from a pipe transfer station 25 at the transition from the transfer zone to the rolling zone 26, and in the rolling zone the pipe is rolled on ramp means 31 to or from a pipe transporting station 27. At the latter, the pipe is rolled onto or off an elongated skate or carriage 32 which moves longitudinally in the transporting zone 20 on a track 34 between the transporting station 27 and a pipe using station 29 (FIG. 14) at the working platform or floor 36 of a drilling rig 35 elevated relative to the level of the pipe transporting station 27. In this regard, the track 34 has a rear generally horizontal section 34*a* at the pipe transporting station and a front upwardly sloped section 34*b*, from the horizontal section 34*a* to the drilling rig floor 36.

Figure 9:
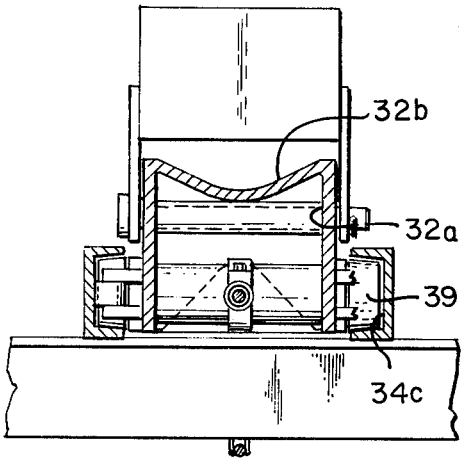
FIG. 9 is a vertical section taken along the line 9—9 of FIG. 8.

The skate 32 is supported on the track 34 by front and rear sets of rollers 38–39 tracking inside track channels 34*c* (FIG. 9) and is of sufficient length of hold a pipe section P. As shown by the phantom view in FIG. 2, the front rollers of the skate are arranged to follow the track up the forward, upwardly inclined track section 34*b*. Referring to FIG. 9, it is seen that the skate 32 is of general channel configuration providing vertical side walls 32*a* between the rollers 38–39 and a center top wall 32*b* which is depressed along its center to serve as a cradle for the pipe.

Figure 7:
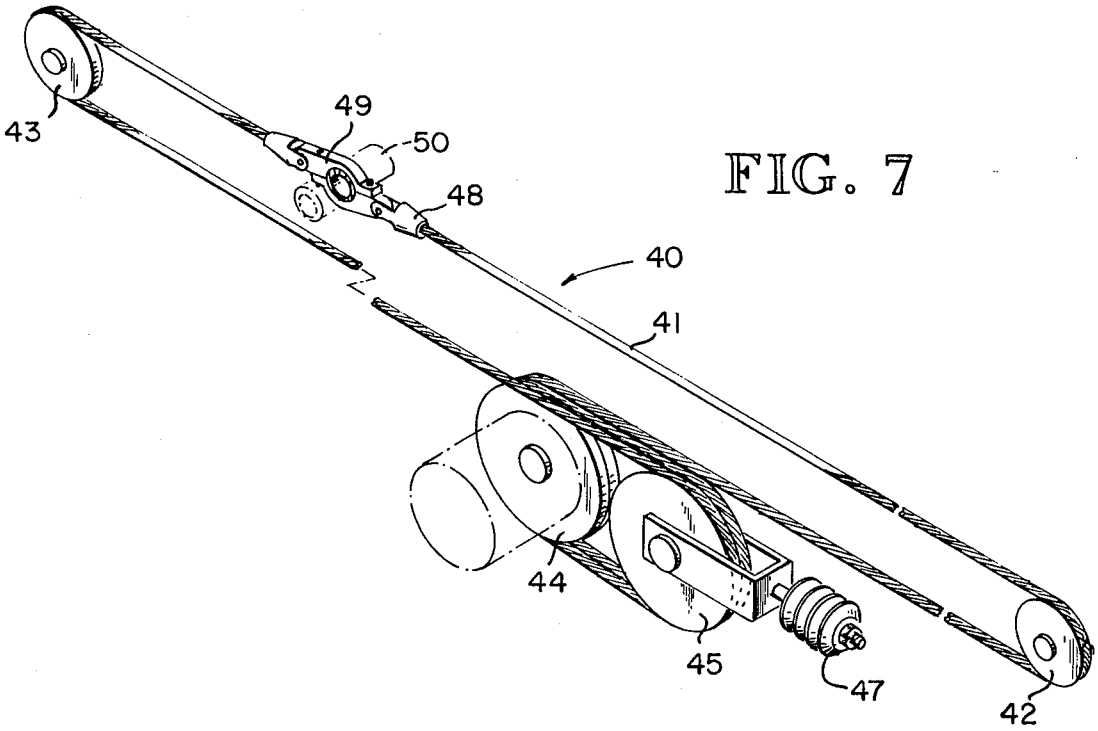
FIG. 7 is an isometric of a drive conveyor for the pipe feeding apparatus shown in FIG. 1.

As best shown in FIG. 7, the skate 32 is shuttled by a traction drive system 40 which includes a cable 41 passing around front and rear end sheaves 42–43, a drive sheave 44 driven by a reversible hydraulic motor 46 and located near the forward end of the horizontal track section 34*a*, and a take-up sheave 45 which is forwardly spring-urged by a take-up mechanism 47 to maintain a constant tension on the cable 41. The ends of the cable 41 are situated in its upper run and are connected by clevises 48 to a horizontal coupling arm 49 which is journal mounted at its center on the right-hand end of the axle 50 for the rear seat of skate rollers 39. With this arrangement, powering of the drive sheave 44 by the motor 46 causes the axle 50, and hence the skate 32, to be pulled forwardly or rearwardly as desired.

A unique feature is that as the skate 32 is pulled forwardly by the conveyor 40 up the front inclined track section 34*b*, the coupling arm 49 remains horizontal by way of its journal mounting on the rear axle 50. In other words, the rear end portion of the skate 32 pivots on the axis of the axle 50 relative to the coupling arm 49 and generally horizontal runs of the conveyor cable 41 as the front end of the skate moves up or down the inclined track section 34*b*. It will be noted from FIG. 2 that the rear wheels 39 of the skate always remain on the rear horizontal track section 34*a*.

Figure 8:
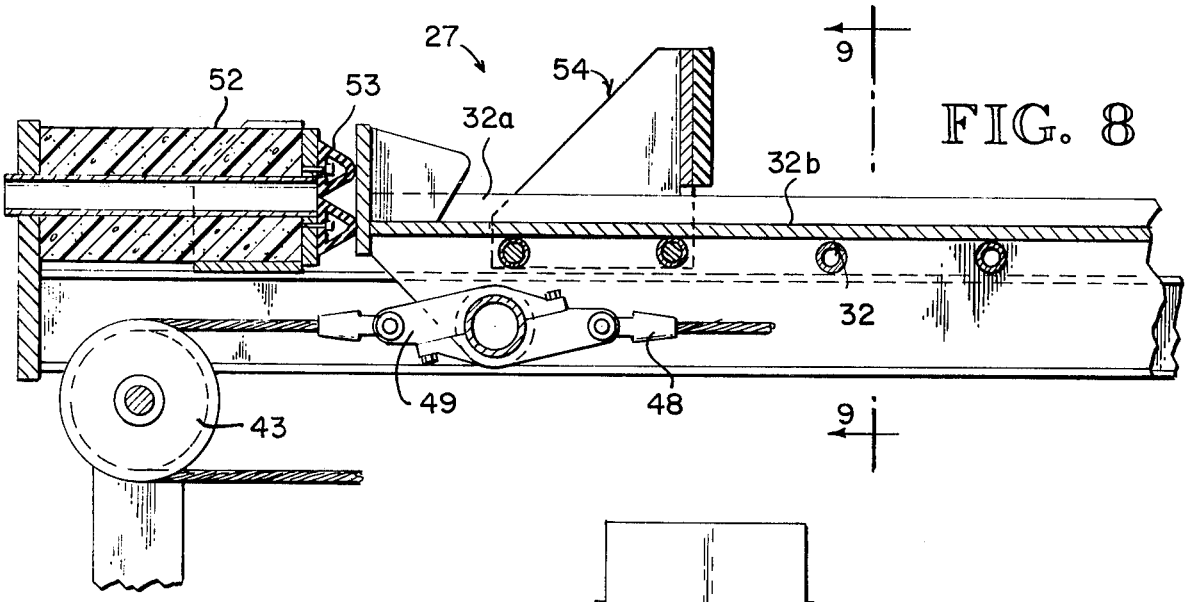
FIG. 8 is a vertical section of a portion of the drive apparatus shown in FIG. 7.

Directing attention to FIG. 8, rearward travel of the skate 32 relative to the track 34 is limited by engagement of a skate crushable emergency stop 52 at the rear end of the skate with a resilient bumper 53 mounted on the track to establish the location of the skate to align with ejectro cylinder 70 shown in FIG. 5. The stop is made of polyurethane or similar shock absorbing material. If the skate cable breaks when skate is in upward position stop 52 will crush absorbing the kinetic energy of the runaway skate to avoid damage to equipment.

Figures 1, 2, 3, 3A, 4:
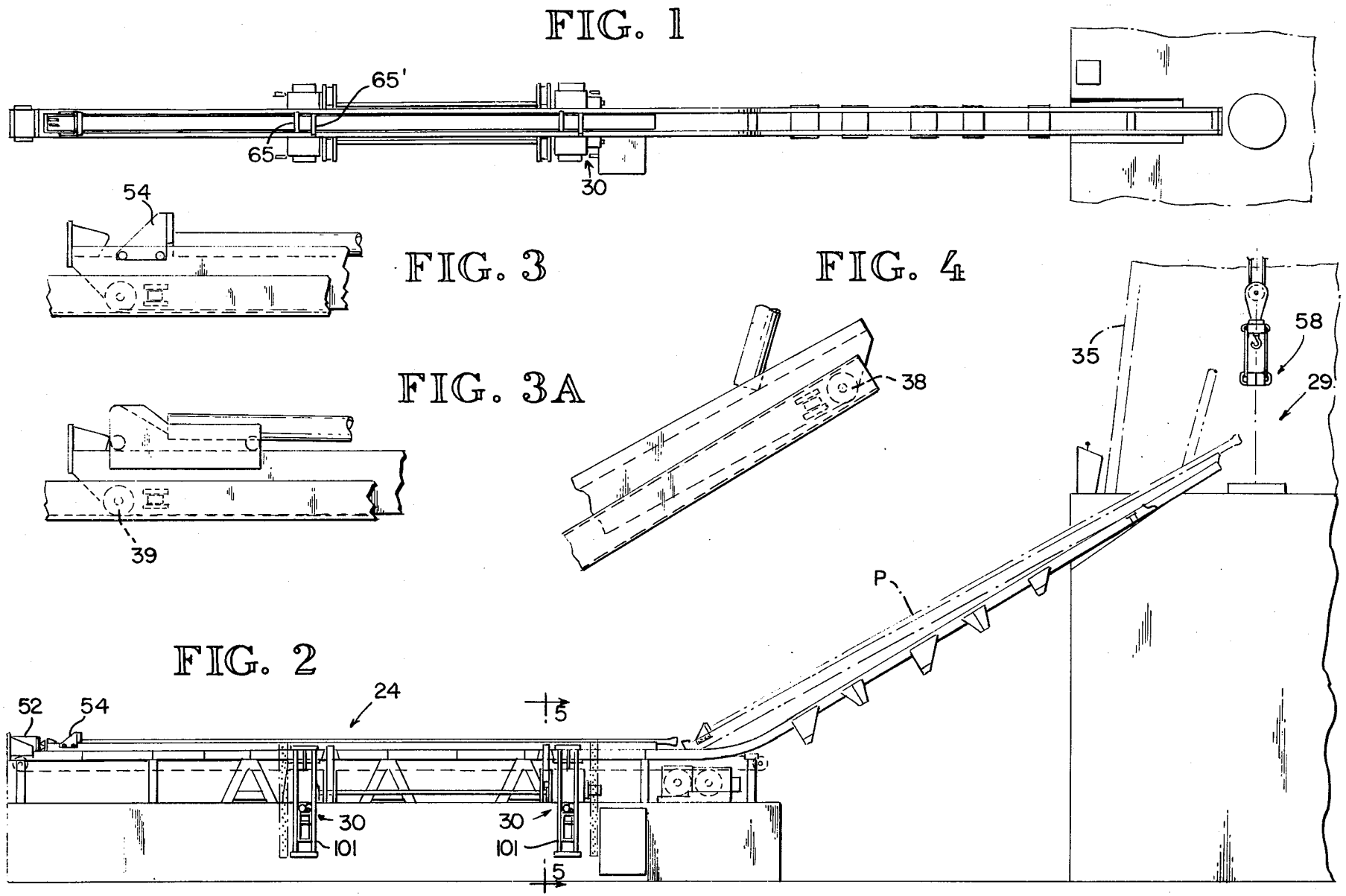
FIG. 1 is a fragmentary plan of a pipe feeding apparatus embodying the principles of the invention.
FIG. 2 is a side elevation of pipe feeding apparatus shown in FIG. 1.
FIG. 3 is a fragmentary detail taken along the line 3—3 of FIG. 1.
FIG. 3A is a fragmentary detail of a modified embodiment.
FIG. 4 is a fragmentary detail of the apparatus shown in FIG. 3 but in a different operational position.

The skate 32 also has an adjustable stop 54 to limit the rearward extent of a pipe section carried by the skate so that the forward end (normally the box end) of the pipe section will project forwardly of the skate to be in a position to be readily gripped by an elevator or hoist 58 adjacent the rig floor 36 when the skate is at the pipe using station 29 as indicated in the phantom view of the pipe in FIG. 2. Then, as the elevator 58 is raised above the rig floor, the rear or pin end of the pipe section skids upwardly along the upper cradle wall 32*b* of the skate until it swings free of the skate into a vertical position. Normally when handling the pipe sections thread protectors are positioned on the pin end of the pipe section. Since drill pipe is of a harder steel than casing pipe, for example, thread protection is generally only needed for the softer casing pipe. When a pipe section is being tripped and retured for storage, it is lowered by the elevator 58 and the lower suspended end of the pipe is swung manually or mechanically into engagement with the upper end portion of the skate, whereupon continued lowering of the pipe by the elevator results in downward skidding of the pipe along the cradle 32*b* until the lower end of the pipe section engages the pipe stop 54. Then the lowering by the elevator is continued until the forward end portion of the pipe section reaches the skate.

The ramp means 31 in each pipe rolling zone 26 comprises alternative sets (each two in number) of ramp plates, one set 61 being sloped to roll pipe downwardly toward the pipe transporting station 27 for loading onto the skate, and the other set 62 being sloped to roll pipe outwardly away from the station 27 to the pipe transfer station 25 after it has been unloaded from the skate. The unloading set 62 is stationary whereas the loading set 61 is removable or otherwise movable into an inactive position to expose the unloading set. The plates are of thin steel members preferably weighing about 30 pounds and thus are easily moved by a workman. As shown in FIG. 5B, each movable ramp plate 61,61' includes a recess 222 that fits over a step 224. The rear of each ramp plate 61,61' includes a notch 220 that fits around a stop 221 in the supporting frame. Thus by inserting the ramp plate rearwardly the rear end becomes locked against vertical movement.

Directing attention to FIG. 5, pipe unloading means 64 is provided for selectively ejecting a pipe section at the pipe transporting station 27 from the skate 32 onto the ramp plates 62 or 62'. This unloading means 64 includes a left swinging pair (set) of ejector plates 65 for pushing a pipe section laterally to the left from the skate onto ramp plates 62, and a right swinging pair (set) 65' for pushing a pipe section from the skate to the right onto ramp plates 62'. These ejector plates are located within respective slots in the upper saddle wall **32*b* of the skate and have their upper edges formed to a concave shape corresponding to the concavity of the cradle wall 32*b* so that, when the ejector plates are in a lowered inactive retracted position within the slots the ejector plates are flush with the saddle wall 32*b*. The right swinging ejector plates 65' are pivotally connected at 67' to the upper part of the right wall 32*a'* of the skate and have their left ends seated on the top of the left wall 32*a* when in retracted position. Similarly, the left swinging ejector plates 65 are pivotally connected at 67 to the left wall 32*a* and have their right ends seated on the right wall 32*a'*** when retracted.

The ejector plates 65–65' have V-shaped bottom edges and have respective cam rollers 68–68' journal mounted at the vertex of the V, the cam rollers being offset to the right and left from the lateral center of the skate, to be engaged by respective flat cam plates 69–69'. These are mounted at the top of the piston rods of left and right hydraulic doubleacting vertical ejector cylinder assemblies 70–70' mounted in a main frame assembly 71 which supports the track 34, ramp means 31, and transfer means 30. When the skate is positioned at the pipe transporting station 27 after carrying a pipe section from the drilling rig 35 for storage, the cylinder assemblies 70 or 70' for the side selected for storage are charged to raise the respective cam plates 68 or 68' and engage the overlying cam rollers 68 or 68' to swing the proper ejector plates 65 or 65' to lift and roll the pipe section in the selected direction.

In order to control rolling movement of the pipe sections in the pipe rolling zone 26 along the ramp means 31, like longitudinally spaced pairs (sets) of indexing means are provided. Each of these pairs comprises outer indexing fingers 73,74 and inner indexing fingers 75,76. The arrangement for the right ramp means 31' is the same. The outer indexing finger 74 and the inner indexing finger 75 have curved bearing faces **74*a*, 75*a* directed, respectively, outwardly toward the pipe transfer station 25 and and inwardly toward the pipe transporting station 27. The other indexing fingers 73,76 have removable rectangular inserts 73*a*,76*a* opposing, respectively, the bearing faces 74*a*,75*a* to accommodate different diameters of pipe between fingers 73,74 and between the fingers 75,76**.

As shown in FIG. 5, the indexing fingers 73–76 are guided in a generally vertical direction and are operated by respective double-acting hydraulic cylinders 77–80 which are mounted on the frame assembly 71. The inner indexing fingers 75,76 are used when the inwardly sloping ramp plates 61 are in operation, and the outer indexing fingers are operated when the outwardly sloping ramp plates 62 are in use. As indicated by the phantom position of finger 76 in FIG. 5, the vertical strokes of the inner fingers 75,76 are such as to project them above the ramp plates 61 when they are in raised active positive, and to retract them below the top of the other ramp plates 62 when they are in inactive position. Similarly, the strokes of the outer indexing fingers 73,74 are such as to extend them above the ramp plates 62 when they are in active position, and to retract them below the top of the ramp plates 61 when they are in inactive position.

When pipe sections are being rolled inwardly toward the skate 32 along ramp plates 61, the innermost finger 76 is extended as a stop, and the finger 75 can then be extended to isolate the innermost pipe section from the rest. When the skate is to be loaded at the pipe transporting station 27 the finger 76 is retracted so that the isolated pipe section is free to roll onto the skate.

Likewise, when pipe sections are being rolled outwardly, the finger 73 is raised to act as a stop, and finger 74 isolates the next pipe. Then finger 73 is retracted, allowing the pipe to roll onto the transfer means 30.

The pipe transfer means 30 on the left-hand side of the apparatus is best shown in FIGS. 2, 5 and 6. The transfer means 30' on the right-hand side is identical and and will not be described in detail. The transfer means 30 includes two transfer units spaced along the pipe transporting station each having powered rollers 86 and 88. The powered rollers are each powered preferably by a variable speed, reversible hydraulic or electric motor. The powered rollers move the pipe lengthwise of the skate to align the pin end with the stop 54 for initially positioning the pipe box so it extends over the end of the skate and for aligning the returning pipe with one of the horizontal pipe layers. The rollers also serve as a bridge to roll the pipe between the ramps 61 and 62 and the pipe racks. This is best shown in FIG. 10 where a pipe P is being moved over the roller 88 and thence will continue its movement onto one of the horizontal pipe racks. Tilting of the powered rollers is obtained by hydraulic actuators 94. The piston rods from these actuators are pivotally mounted to a carrier 97. Thus, as best shown in FIG. 5, extension of the actuator 94 will tilt the powered roller 86 counterclockwise.

The carrier 97 is pivotally mounted to an elevator 100. Elevator 100 is guided in vertical rails 101 by rollers 102 and 103. Vertical movement of the elevator is obtained by a reversible motor 104 which drives a chain 106. Thus, as is readily apparent the powered rollers 86 can be vertically positioned along any vertical location of the pipe racks. In addition, the vertical positioning of the powered rollers provides precise alignment between the surface of the powered roller and the top surface of either set of ramp plates 61 or 62. That is, when ramp plates 62 are used, their top surfaces are lower than ramp plates 61 and thus the elevator will lower the powered rolls slightly to receive pipe rolling from the ramp plates. The pipe is normally moved lengthwise while the powered rollers are set as a V in the position shown in FIG. 11 so that they form a trough with the pipe centered between. Discharge of the pipe to the pipe racks is shown in FIG. 10 with the powered rollers 86 positioned at an angle. Delivery of the pipe from the powered rollers to the pipe delivery ramp plates 61 is done by tilting the powered rollers into the position shown in FIG. 12.

Movement of the pipe onto or off the powered rollers from the pipe racks is preferably accomplished by an operator manually pushing the pipe. Various alternative techniques are possible, however. For example, one technique is to flip the powered rollers quickly to give an initial momentum to the pipe when moving pipe off the powered rollers.

One novel technique for moving pipe to or from the racks by gravity rolling is shown in FIGS. 2 and 5A. In this embodiment, pipe P is rolled onto the layers of pipe each of which are separated by battens 200. For this purpose each elevator 100 has a perforated bracket or board 202 attached thereto. The perforations receive the ends or dowels 203 of transfer beams 204 which intercept the pipe carried on the sets of rollers 86 and 88. The opposite ends of the transfer beams rest between the battens on a lower layer of pipe. The dowels are retained by cotter pins 206. By providing a multitude of holes in the bracket the vertical position of the transfer beam can be adjusted in fine increments. When rolling pipe onto the pipe racks the transfer beams are given a slight outward and downward inclination to gravity roll the pipe onto the battens. The transfer beams are arranged either horizontally or at a slight outward and downward inclination to move pipe off the racks and onto the powered rolls 86 and 88. The brackets 202 can be inexpensively provided in a pipe handling system as shown in FIG. 2 and used or not used depending upon the desires of the user.

FIG. 3A illustrates a modified embodiment in which a roller sub-skate 32*a* rides on the skate 32 to support the end of the pipe and protect it from damage as it is moved therealong.

Figure 11:
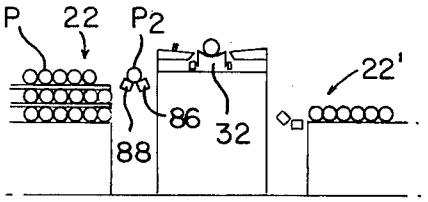
Figure 12:
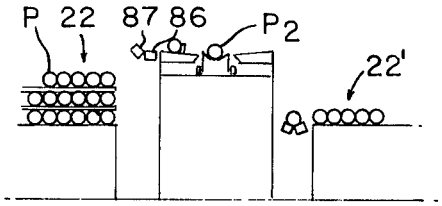
Figure 13:
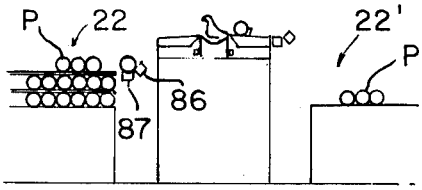

The overall operation and method of this invention can best be described with reference to FIGS. 10–16. The description will first proceed with a typical drill string formation procedure. Pipe P from either the left-hand or right-hand pipe racks 28–28' is moved to the respective pipe delivery ramp plates 61 or 61' which are positioned to provide a gravity roll toward the elongated skate 32. In FIG. 10 a first pipe P-1 is shown on the elongated skate 32 having just been positioned there by the indexing finger 76. The right-hand pipe transfer unit 30' is in a position to start returning to its pipe rack to pick up additional pipe. At the same time a pipe P-2 is shown being moved onto the left-hand transfer unit 30 from the left pipe rack. This pipe P-2 is shown in FIG. 11 as being rolled in the trough formed between the two rollers 86,88 lengthwise to position it to be desired location on the now empty elongated skate 32. The elongated skate, as is understood, has in the interim moved the pipe P-1 from the horizontal position up the ramp 34*b* into the position shown in FIG. 15. At this time the workmen on the drill rig floor 36 will connect the drawworks elevator 58 to the free end of the pipe and pull the pipe up to the position shown in FIG. 16. The opposite end of the pipe is of course slid on skate 32 or carried on the movable sub-skate 32*a*. When the pipe is free of the skate, the elongated skate is moved back to its initial position. At this time, the pipe P-2 is then moved onto the elongated skate as shown in FIG. 12. The pipe is fed from either side of the pipe feeder although a single horizontal rack on one side can also be used. Tripping and storing of pipe operates in just the reverse manner.

While the preferred embodiments of the invention have been illustrated and described, it should be understood that variations will be apparent to one skilled in the art without departing from the principles expressed herein. Accordingly, the invention is not to be limited to the specific embodiment illustrated.

The embodiments of the invention in which a particular property or privilege is claimed are defined as follows:

1. A pipe handling system comprising, a pipe storage zone, pipe transfer zone, pipe rolling zone, and pipe transporting zone adjoining one another in the recited order;

said pipe storage zone having a bank of vertically spaced pipe storage areas with respective pipe storage stations exposed to said transfer zone, said rolling zone having a pipe transfer station exposed to said transfer zone and having a pipe transporting station laterally spaced from said transfer station and exposed to said transporting zone, and said transporting zone having a pipe using station spaced endwise from said transporting station and located at a level higher than the latter;

pipe transfer means in said transfer zone for transferring a length of pipe either way between a selected one of said storage stations and said transfer station;

pipe rolling means and indexing means in said rolling zone adapted, respectively, to selectively provide a gently sloped roll support either way for multiple lengths of side-by-side pipe between said transfer station and transporting station and to selectively receive or discharge such lengths one at a time at the transfer station or transporting station;

pipe transporting means in said transporting zone having an elongated carriage adapted to carry and transport an entire length of pipe lengthwise either way between a generally horizontal position at the transporting station and an upwardly sloped position at the pipe using station; and pipe unloading means in said transporting zone including pipe unloading ejectors on said carriage for moving a length of pipe from the carriage to said transporting station and including actuating means located beneath and free of said carriage for selectively powering said ejectors when the carriage is situated at said transporting station.

2. A pipe handling system according to claim 1 in which said pipe storage zone, pipe transfer zone, and pipe rolling zone, together with the pipe transfer means and pipe rolling and indexing means, are duplicated on the other side of said transporting zone, and said pipe unloading means includes additional unloading arms and actuating means for moving a length of pipe from said carriage to the transporting station on said other side.

3. A pipe handling system according to claim 1 in which said pipe transfer means comprises:

cradle means in said pipe transfer zone, rocking means for selectively rocking said cradle means back and forth from an upright pipe holding position toward said bank of storage areas or toward said pipe transfer station, and elevator means carrying said cradle means and rocking means for selectively moving the cradle means vertically between the level of the pipe transfer station and the levels of said pipe storage stations.

4. A pipe handling system according to claim 3 in which roller means are mounted on the cradle means for moving a length of pipe endwise on the cradle means a selected distance when the cradle means is in its upright pipe holding position for laterally aligning the pipe relative to the station to which it is to be moved.

5. A pipe handling system according to claim 1 in which said pipe rolling means comprises:

lower stationary ramp means sloping from said transporting zone downwardly to said transfer zone, upper ramp means movable from an active position, whereat the lower ramp means is inactive, to an inactive position, whereat the lower ramp means is active, said upper ramp means sloping from said transfer zone downwardly to said transporting zone to a level higher than the upper end of said lower ramp means when the upper ramp means is in active position.

6. A pipe handling system according to claim 5 in which said indexing means includes first and second sets of vertically movable fingers in said rolling zone at said pipe transporting station adapted when in upwardly extended position to isolate a length of pipe therebetween which is supported on said upper ramp means, said fingers having a lowered retracted position below the level of said lower ramp means, and means for selectively moving said first and second sets of fingers independently between their extended and retracted positions.

7. A pipe handling system according to claim 6 in which said indexing means also includes third and fourth sets of vertically movable fingers in said rolling zone at said pipe transfer station adapted when in upwardly extended position to isolate a length of pipe therebetween which is supported on said lower ramp means, said fingers of said third and fourth sets having a lowered retracted position below the level of said lower ramp means, and means for selectively moving said third and fourth sets of fingers independently between their extended and retracted positions.

8. A pipe handling system according to claim 5 in which said pipe unloading means is adapted to move a length of pipe from said carriage to the upper end of said lower ramp means when said upper ramp means is inactive, and in which the lower end of said upper ramp means is sufficiently higher than the upper end of the lower ramp means when the upper ramp means is active as to permit a length of pipe to roll by gravity onto said carriage from the upper ramp means.

9. A pipe handling system according to claim 1 in which said pipe using station is located at the working platform of an oil drilling derrick, and means are provided for unloading transported pipe or loading tripped pipe at said pipe using station.

10. A pipe handling system according to claim 1 in which said pipe transporting means includes a track for said elongated carriage, said track having a generally horizontal track section extending forwardly from said pipe transporting station and having a ramp section sloping upwardly in the forward direction from the forward end of said horizontal track section to said pipe using station, said carriage having rear wheels constantly riding on said horizontal track section and having front wheels riding on both of said track sections in the course of the travel of the carriage between the pipe transporting station and the pipe using station.

11. A pipe handling system according to claim 10 in which said pipe transporting means also includes means for selectively pulling said transporting means back and forth along said horizontal track section.

12. A pipe handling system according to claim 1 in which a secondary carriage is mounted to ride along said elongated carriage and carry that end of a length of pipe on the elongated carriage which is the more remote from said pipe using station.

13. An apparatus for moving horizontal lengths of pipe vertically and laterally in a vertical transfer zone situated between a pipe transfer station at one side and a bank of vertically spaced pipe storage stations at the opposite side, cradle means adapted to operate in said zone, rocking means for selectively rocking the cradle means back and forth from an upright pipe holding position toward said bank and toward said pipe transfer station for discharging and receiving pipe in both lateral directions, elevator means carrying said cradle means and rocking means for selectively moving the cradle means vertically between the level of the pipe transfer station and the levels of said pipe storage stations, and roller means on the cradle means for moving a length of pipe axially on the cradle means a selected distance when the cradle means is in its upright pipe holding position to thereby laterally align the pipe relative to the station to which it is to be moved.

14. Apparatus according to claim 13 in which said cradle means comprises two sets of rollers arranged to provide a generally V-shaped cradle between said sets, and means for selectively powering at least one of said sets.

15. Apparatus according to claim 13 in which said elevator means comprises a pair of spaced columns, a pair of carriages slidably mounted on respective said columns, and powered chain means for selectively moving said carriages vertically along said columns, said cradle means comprising a pair of aligned cradles pivotally mounted on respective said carriages to swing toward and away from said columns on a common swing axis, and pressurized fluid cylinder means extending between said carriages and said cradles in spaced relation to said swing axis.

16. Apparatus according to claim 15 in which each of said cradles has two respective rollers journal-mounted thereon and arranged to collectively provide a generally V-shaped pipe support.

17. Apparatus according to claim 16 in which one of said rollers on each cradle is powered to selectively rotate in either direction.

18. A pipe handling system for rolling multiple lengths of pipe laterally in a controlled manner between a transfer station and a pipe transporting station for a pipe transporting carriage, stationary lower ramp means sloping from said transfer station upwardly to said transporting station to a level whereat a length of pipe rolling out of said carriage when at the transporting station will roll onto said lower ramp means, upper ramp means movable from an active position, whereat the lower ramp means is inactive, to an inactive position, whereat the lower ramp means is active, said upper ramp means sloping from said transfer station downwardly to said transporting station to a level higher than the upper end of said lower ramp means when the upper ramp means is in active position whereby a length of pipe can roll from the upper ramp means onto said carriage when at the transporting station, and indexing means at said stations for selectively isolating a length of pipe at said transporting station when said upper ramp means is active, and for selectively isolating a length of pipe at said transfer station when said lower ramp means is active.

19. A pipe handling system according to claim 18 in which said indexing means includes first and second sets of vertically movable fingers at said pipe transporting station adapted when in upwardly extended position to isolate a length of pipe therebetween which is supported on said upper ramp means, said fingers having a lowered retracted position below the level of said lower ramp means, and means for selectively moving said sets of fingers independently between their extended and retracted positions.

20. A pipe handling system according to claim 19 in which said indexing means includes second and third sets of vertically movable fingers at said pipe transfer station adapted when in upwardly extended position to isolate a length of pipe therebetween which is supported on said lower ramp means, said fingers having a lowered retracted position below the level of said lower ramp means, and means for selectively moving said third and fourth sets of fingers independently between their extended and retracted positions.

21. A pipe handling system according to claim 19 in which each of said first set of fingers has a stop face directed toward said second set and toward said transfer station, and each of said second set has a concave face directed toward said first set, and width adjusting means for adjusting the distance between said stop faces and the opposing said concave faces for accommodating various diameters of pipe therebetween.

22. A pipe handling system according to claim 21 in which said width adjusting means comprises a removable insert at said stop face of each of said first set of fingers.

23. In a pipe handling system, ramp means for gravity rolling pipe laterally in a rolling zone, two indexing fingers in the rolling zone movable between an upwardly extended position for isolating a length of pipe therebetween which is supported on the ramp means, and a lowered retracted position below the level of said ramp means, means for selectively moving said fingers independently of one another between said extended and retracted positions, and width adjusting means for adjusting the distance between said fingers above the ramp means when the fingers are in their extended position, the finger on the uphill side of the ramp means having its downhill face sloping uphill so that the finger narrows in width toward its upper end, said width adjusting means comprising a removable insert in the uphill face of the other finger.

24. In a pipe handling system, an elongated skate movable along a track for transporting a length of pipe, means for removing pipe ejected from the skate, ejecting means mounted on said skate for underlying the pipe and movable between a lowered retracted position and an extended pipe ejecting position, and actuator means located below said track out of the path of movement of said skate and extendible upwardly into engagement with said ejecting means for moving the ejector means into said pipe ejecting position to move pipe off the skate to said pipe removing means, said ejecting means including a plurality of vertical plates each pivotally mounted on said skate and having an upper ejecting end and a lower cam end, cam rollers on said cam ends, said actuators including cylinders having extendible piston rods engageable with said cam ends for pivoting the plates from retracted position to pipe ejecting position, said piston rods having flat ends over which the cam rollers can move and alignment means for guiding the piston rods in a straight line as they are extended.

25. In a pipe handling system an elongated skate movable along a track for transporting a length of pipe, means for removing pipe ejected from the skate, ejecting means mounted on said skate for underlying the pipe and movable between a lowered retracted position and an extended pipe ejecting position, actuator means located below said track out of the path of movement of said skate and extendible upwardly into engagement with said ejecting means for moving the ejector means into said pipe ejecting position to move pipe off the skate to said pipe removing means, and said pipe removing means including a first ramp inclined away from said track for gravity rolling ejected pipe away from the skate, and a second ramp positionally higher than said first ramp and inclined in the opposite direction for rolling pipe to the skate, the rolling direction being determined by selection of the desired ramp.

26. In the pipe handling system of claim 25, a plurality of indexers spaced along said ramps for controlling the rolling of pipe along the ramps and isolating one pipe from the remaining pipes on the respective ramp.

27. A system for feeding pipe to a floor of a drilling rig, comprising:

an elongated track having a horizontal run including a first end remote from the rig floor and an inclined ramp having a second end elevated from said first end and adjacent the rig floor, a unitary elongated skate supporting the full length of the pipe and mounted for movement along said track between a substantially horizontal position to an inclined position with one end of the skate lying on the ramp, and the other end lying on the horizontal run, a track on the skate for guiding the end of a pipe along the skate, power means for moving the skate forwardly along said horizontal run and thence upward onto said ramp, and stop means carried by the skate for limiting rearward movement of the pipe along the track in the skate.

28. The system of claim 27, said skate having a carriage movably positioned thereon for supporting the rearward end of the pipe for movement along the track in the skate from an initial position after the skate is in said inclined position.

29. The system of claim 28, said stop means being adjustably mounted for locating said initial position of said carriage to thereby adjust the location of the pipe when initially positioned on said skate.

30. The system of claim 27, said power means including an elongated conveyor, said end of said skate lying on said horizontal run being supported by at least one roller rotatable about a horizontal axis, said conveyor being coupled to said skate along the axis of said roller so that the skate can be inclined about said axis without said axis being moved vertically off said conveyor.

31. A pipe handling system comprising, a pipe moving means for moving lengths of pipe laterally in a controlled manner between a transfer station and a pipe transporting station laterally spaced from one another, carriage means for transporting lengths of pipe endwise in a given direction from said transporting station and including a stop for limiting movement of the pipe endwise relative to the carriage means in the opposite direction, and pipe transfer means for selectively moving horizontal lengths of pipe vertically and laterally to said transfer station in a vertical transfer zone from a bank of pipe storage stations located on the opposite side of said zone from said transfer station, said pipe transfer means including vertically movable conveyor means, said conveyor means including powered roller means for selectively moving the pipe endwise in said transfer zone while being moved from one of said storage stations to the transfer station whereby the pipe will be properly orientated endwise relative to said stop when arriving at said transporting station.

32. A pipe handling system according to claim 31, said pipe moving means including a ramp for rolling the pipe laterally from the transfer station toward the transporting station.

33. A pipe handling system according to claim 31 in which said pipe transfer means comprises:

cradle means adapted to operate in said zone, rocking means for selectively rocking the cradle means back and forth from an upright pipe holding position toward said bank and toward said pipe transfer station for receiving and discharging pipe in both lateral directions, elevator means carrying said cradle means and rocking means for selectively moving the cradle means vertically between the level of the pipe transfer station and the levels of said pipe storage stations, and said roller means being on the cradle means for moving a length of pipe endwise on the cradle means a selected distance when the cradle means is in its upright pipe holding position to thereby laterally align the pipe relative to the station to which it is to be moved.

34. Apparatus according to claim 33 in which said cradle means comprises two sets of rollers arranged to provide a generally V-shaped cradle between said sets.

35. The apparatus of claim 31, including perforated brackets at the ends of said pipe storage stations closest to said vertical transfer zone, transfer beams secured to said brackets in the path of said pipe moving in said vertical transfer zone for delivering pipe to or from the pipe transfer means depending on the inclination of the transfer beams.

36. The apparatus of claim 35, said transfer beams each having one end secured in a perforation of the bracket and a free end resting on a pipe in the pipe storage station.

37. A system for feeding pipe to a floor of a drilling rig, comprising:

an elongated track having a horizontal run including a first end remote from the rig floor and an inclined ramp having a second end elevated from said first end and adjacent the rig floor, an elongated skate supporting the full length of the pipe and mounted for movement along said track between a substantially horizontally position to an inclined position with one end of the skate lying on the ramp, and the other end lying on the horizontal run, power means for moving the skate forwardly along said horizontal run and thence upward onto said ramp, stop means carried by the skate for limiting rearward movement of the pipe along the skate, and means for limiting movement of the skate as it returns from an inclined position, said limiting means including an emergency stop having a crushable material designed to absorb the kinetic energy from a runaway skate.

* * * * *